US011746532B1

(12) United States Patent
Poma et al.

(10) Patent No.: US 11,746,532 B1
(45) **Date of Patent: *Sep. 5, 2023**

(54) PICKET RAILING ANCHOR SYSTEM

(71) Applicants: Justin G. Poma, Port Saint Lucie, FL (US); Jason F. Poma, Palm City, FL (US); Francesco Poma, Port Saint Lucie, FL (US)

(72) Inventors: Justin G. Poma, Port Saint Lucie, FL (US); Jason F. Poma, Palm City, FL (US); Francesco Poma, Port Saint Lucie, FL (US)

(73) Assignee: Poma & Sons, Inc., Palm City, FL (US)

( * ) Notice: Subject to any disclaimer, the term of this patent is extended or adjusted under 35 U.S.C. 154(b) by 262 days.

This patent is subject to a terminal disclaimer.

(21) Appl. No.: 17/135,077

(22) Filed: Dec. 28, 2020

Related U.S. Application Data

(63) Continuation-in-part of application No. 15/683,410, filed on Aug. 22, 2017, now Pat. No. 10,876,297.

(51) Int. Cl.
*E04F 11/18* (2006.01)

(52) U.S. Cl.
CPC ..... *E04F 11/1812* (2013.01); *E04F 11/1817* (2013.01); *E04F 11/1836* (2013.01); *E04F 2011/1823* (2013.01); *E04F 2011/1889* (2013.01)

(58) Field of Classification Search
CPC ... E04F 11/18; E04F 11/1812; E04F 11/1817; E04F 11/1836; E04F 11/1842; E04F 11/1844; E04F 11/1846; E04F 11/1851
See application file for complete search history.

(56) References Cited

U.S. PATENT DOCUMENTS 4,793,110 A * 12/1988 Tucker ..... E02D 27/00 248/188.4
6,618,953 B2 * 9/2003 Izumi ..... E04F 11/1814 33/534
6,964,410 B1 * 11/2005 Hansen ..... E04F 11/1851 256/65.02
8,181,405 B2 * 5/2012 Nash ..... E04F 11/1851 52/800.18
8,776,477 B2 * 7/2014 Sprague ..... E04F 11/1851 52/126.5
8,820,721 B1 * 9/2014 Poma ..... E04H 9/14 256/65.14
9,127,474 B2 * 9/2015 Tinwala ..... E04F 11/1812
9,470,038 B2 * 10/2016 Ona-Gonzalez ..... E04H 15/005
9,617,736 B2 * 4/2017 Zhou ..... E04F 11/1812
9,657,760 B2 * 5/2017 Giacometti ..... F16B 5/0685
9,683,402 B2 * 6/2017 Abdul Lathief .... E04F 11/1846
(Continued)

*Primary Examiner* — Jonathan P Masinick
(74) *Attorney, Agent, or Firm* — Dale Paul DiMaggio; Malin Haley DiMaggio & Bowen, P.A.

(57) ABSTRACT

An improved picket railing anchor system for multiple picket railings for buildings, balconies, and decks, which can experience different forces being applied by people, objects or hurricane strength winds. The system includes an elongated base member having integral keyways which receive anchor assemblies having mounting plates, elevated rails and a central mounting post that also can elevate the base member to allow for drainage. The anchor assemblies are slidable and can be selectively positioned for easy and secure installation.

12 Claims, 11 Drawing Sheets

(56) References Cited

U.S. PATENT DOCUMENTS

| | | | | |
|---|---|---|---|---|
| 10,876,297 | B1 | 12/2020 | Poma et al. | |
| 2011/0219722 | A1* | 9/2011 | Feigl | E04F 11/1812 52/698 |
| 2012/0043034 | A1* | 2/2012 | Feigl | E04F 11/1853 160/368.1 |
| 2013/0248792 | A1* | 9/2013 | Bangratz | E04F 11/1851 256/24 |
| 2017/0101784 | A1* | 4/2017 | Gonzato | E04F 11/1853 |
| 2017/0292274 | A1* | 10/2017 | Downs | E04F 11/1812 |

* cited by examiner

PICKET RAILING ANCHOR SYSTEM

CROSS REFERENCE TO RELATED APPLICATIONS

This application claims the benefit of, and priority from, U.S. Utility Application, Ser. No. 15/683,410, filed on Aug. 22, 2017, issued as U.S. Pat. No. 10,876,297 on Dec. 29, 2020.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to an improved anchor system for picket railings, and more particularly, to a picket railing anchor system that uses an adjustable sliding anchor assemblies having an anchor post, mounting plate and two elevated rails, the anchor assemblies being selectively positioned along a aluminum base bottom rail. The improved anchor assemblies provide for manufacturing, assembly and installation of picket railings, enhance the structural support and stability of the railings, and improve the distribution of tensile and compressive loads on the entire railings and anchor and anchor system, allowing greater use of the picket railing anchor system in general and in particular high velocity wind zones, such as high velocity hurricane zones ("HVHZ").

2. Description of the Background Art

The instant improved anchor system for picket railings is an engineering evolution improving upon the earlier system of the same inventors herein, and as shown, described and claimed in U.S. Pat. No. 10,876,297, and assigned to Poma & Sons, Inc.

U.S. Pat. No. 10,876,297 provides for a discussion of the relevant prior art, shortcomings in conventional glass railing anchor systems, and details the Applicants' prior creative system. U.S. Pat. No. 10,876,297 is expressly incorporated by reference herein, and the instant application and inventions are a substantial advance in the engineering designs in terms of both structural integrity, production, installation, maintenance and life span of picket railings.

Therefore, the instant invention improves upon conventional picket railing systems and structures, as well as Applicants' prior glass railing anchor system in several advantageous aspects and applications to picket railings as disclosed and claimed herein.

SUMMARY OF THE INVENTION

Aluminum picket guardrails are amongst the most well rounded and most practical overall railing design in today's marketplace and perhaps throughout history. They are arguably the safest, most widely used, readily available design that is affordable, feature exceptional strength and durability and require little to no maintenance. Unfortunately, given the popularity of picket railing systems, there exists are a vast number of manufacturers and suppliers with a variety of designs, manufacturing and installation techniques creating differing problems. These variations, historical inability to be field adjusted due inflexible design, along with the improper execution of pre-installation such as accurate placement of railing post pocket blockouts, have a profound impact on safety and performance of all railings alike. The resulting latent and inherent defects can be devastating to both the safety of workers and future residents, and also diminish the expected service life and resiliency of both the railing safeguard and reinforced concrete substructure. Coupled with the numerous design flaws, picket railings have remained virtually unchanged in terms of function and aesthetics since their inception. Designs are typically comprised of two or more horizontal channel or tube components which support the minimal profiled vertical picket railing infill. The horizontal channels and picket infill assemblies are then supported by the main support structure by way of larger sized vertical post supports that are embedded directly into the concrete substructure and anchored with alkaline grout. These immovable posts are normally situated at fixed distance of approximately 4 to 5 feet and that entire assembly is then repeated. The resulting effects are decades old designs of larger sized post components combined with smaller sized picket components in succession of one another with a continuous top rail and bottom rail that is interrupted by the large railing post support. Over the years there have been only a few minor deviations and mundane designs amongst the several thousand suppliers around the U.S., but for the most part, the designs and functionalities are indistinguishable from one supplier to another to those outside of the construction industry.

The instant inventions and picket rail designs improve upon Applicants prior inventive systems and blend that technology to create the instant picket railing system which features a unique configuration and state of the art attachment system that permits the railing to be installed without the use of foam blockouts, or accommodate misplaced blockouts by simple field adjustment of the anchor location. Foam blockouts, which are ordinarily subject to improper placement, have been a historical issue throughout time in the construction industry and contribute to many construction defect claims. It is simple enough to envision a fixed railing system with predetermined factory fabricated fixed railing post locations, but the position of the foam railing post blockouts casted within the post tension cable reinforced structure is incorrectly placed, or modified and installed directly on top of a reinforcement by a relatively unskilled minimum wage construction worker. Now, multiply this isolated incident thousands of times and the enormous scope of real-life, actual everyday issues and problems which need to be addressed on many construction projects throughout the country become clear. Once the sleeves are misplaced or improperly positioned over top of a reinforcing member there are only a few options to remedy, and in the end any option sacrifices either the railing system and its attachment to the structure, the integrity of the host structure and embedded reinforcements, or in many cases both defects. The damage caused by these common practices can be financially devastating for residents and condominium associations, as well fatal in the event of an unexpected structural failure.

Traditional picket railing systems are designed and fabricated with predetermined and fixed post locations, and, in the new construction industry, require the installation of foam block-outs to be casted within the reinforced concrete structure. These foam sleeves are routinely misplaced, improperly installed or not installed altogether which inevitably requires commonly unregulated modification to the factory manufactured railing product, and or host structure. These modifications are typically implemented in a few ways: 1. Cutting of the railing post reducing the anchor embedment depth which coincides with installation of rail posts directly over top of steel reinforcing members. As most railing posts are hollow, they act as a conduit to funnel salt laden condensation directly onto steel reinforcing members which leads to rapid deterioration of the reinforcing members and surrounding concrete, eventually leading to significant risk to life and safety; 2. New holes are core-drilled into the reinforced concrete structure at the correct location. This core-drilling process almost certainly damages steel reinforcements in nearly every instance. When repeated consecutively, it is not uncommon to severe the edge reinforcing bar along the entire length of the balcony or structure. The discontinuity of edge reinforcing bars significantly and adversely affects the performance, service life and resistance to breakout in high loading events. In the most extreme cases the results can be disastrous and deadly.

Drawing from the revolutionary design of its glass railing counterpart, the instant picket railing features adjustable anchors so they can easily be adjusted to accommodate misplaced foam sleeves. If sleeves are not installed, Applicants' designs include two varying attachment methods which feature small diameter anchors that can be drilled with nondestructive methods and properly positioned so that damage to reinforcements is prevented.

Traditional picket railing systems are also designed and fabricated with predetermined and stationary, inflexible post locations, usually spaced a maximum of 4' to 5' from one another. Due to the significant spans of the structural elements, various loading requirements and safety factors, the resulting forces are considerable. These substantial loads are then transmitted to the concrete structure, so it is common for a minimum post embedment depth on this configuration of railing system to be specified approximately 3½" to 4". As most reinforced concrete balconies range between 4½" to 7" thick at the balcony edge, and require a minimum concrete cover of 1½" to 2" over deformed reinforcing bars, with post tensioned cable reinforcements typically centered within that edge profile, a typical railing post embed will overlap within the field depth of those reinforcements. When sleeves are improperly installed, or not installed at all, it is necessary to drill down through these reinforcements, severing them entirely, in order to achieve proper railing post embedment depth. In addition, the likelihood of severing reinforcements concealed within the concrete structure is near an absolute certainty due to the sizing of these core-drilled holes which commonly rage from 4" to 5" in diameter.

A direct benefit of the unique configuration of the instant picket rail system features a specially designed continuous structural bottom rail with an integral tracking system, and the frequency of the concealed anchors can be increased without adding unnecessary viewing obstructions, and those additional anchors thereby allows the anchor depth to be reduced to a point where, in most cases, the designed anchor depth can be met without overlapping the field depth of embedded reinforcements and especially the ever critical post tension reinforcements. The more frequent spacing also allows for more uniform load distribution which is especially critical for older construction projects where the concrete structure may already be compromised due to past events or degradation. In the event sleeves or blockouts are not properly installed or missing entirely, this allows the anchors to be installed to the proper depth without sacrificing the integrity of the railing or supporting concrete substructure. If contact is made during the nondestructive hole drilling operation, any hole can simply be relocated, with very little effort, a small distance laterally in either direction so that contact with reinforcements or resulting damage is prevented.

Railing posts on traditional picket railing systems are anchored in two ways, either by baseplated attachments which are fastened to the structure with mechanical anchors, or the far more prevalent method of embedding the aluminum post into a sleeved or drilled hole pocket and filling that void with a cementitious anchoring grout. While baseplate attachment methods still have several of the same drawbacks, the more popular grouted method has several more inherent issues. The cementitious materials used to set the aluminum posts into the core holes are available in a multitude of different formulations. Each reacts differently than the surrounding substrate. In some cases, it expands causing the balcony edge to blowout; in others, it shrinks, allowing saltwater intrusion to cause a reaction between the aluminum and steel reinforcement bars. Additionally, some of these products are so alkaline that they attack the aluminum post directly, causing the aluminum to deteriorate from alkali attack. In this case, the post can become completely detached at the post pocket elevation.

Applicants' system utilizes corrosion free stainless attachments which are anchored into the concrete foundation with 2-part high strength epoxies. These epoxy anchoring adhesives are superior to cement based grouts in many aspects. Not only do epoxy adhesives have substantially better bonding characteristics which offer improved breakout resistance, but they are inert and impervious to moisture intrusion which enables the entire system to be isolated and unaffected by chemical, environmental or electrochemical reactions.

Finally, railing posts on traditional picket railing systems are comprised of hollow aluminum extrusions which allow water & chlorides to seep through the joint between the post and the cap, or through splice joints located directly over the post. The post allows a direct conduit for electrolyte solutions to enter the center of the slab. This causes further damage by allowing the water to infiltrate into the edge of the slab causing including corrosion of the steel rebar, degradation of the concrete, and corrosion of the aluminum post due to galvanic corrosion and alkali attack. In environments subject to freeze/thaw cycles, the condensation that finds is way inside the post or post pocket can expand causing the slab to crack. In other cases, the railing post lift out of the slab, and in some more severe cases, the posts can actually split open, creating significant hazards to residents.

Instead of hollow extrusions as posts, the instant picket railing system and structural components utilizes specially designed solid core, corrosion free stainless attachments which do not act as a conduit or permit water or chlorides to seep into the system components or through any of the attachments. The system is specifically designed to prevent water or chlorides from infiltrating into the structure which is the primary culprit behind the most adverse and rapid cases of corrosion and accelerated deterioration.

It is, therefore, to the effective resolution of the aforementioned problems and shortcomings of the prior art that the present invention is directed. The instant invention and Applicants' picket rail system and components, including the picket railing anchor system that utilizes custom adjustable sliding anchor assemblies having an anchor post, mounting plate and elevated rails that are selectively positioned along a aluminum base bottom rail, addresses these unfulfilled needs in the prior art by providing the system disclosed and claimed herein.

In accordance with the instant invention, it is an object thereof to provide an improved picket railing anchor system and method for installation.

It is a further object to provide a picket railing anchor system that prevents water intrusion.

It is a further object to provide a picket railing anchor system that eliminates traditional drilling methods into concrete, eliminating the risk of degradation of the concrete, spalling, compromise of post-tensioning cables and/or corrosion of the rebar.

It is a further object to provide a picket railing anchor system and method of installation that prevents galvanic reactions and contact from dissimilar, incompatible materials such as aluminum and concrete.

It is a further object to provide a picket railing anchor system and method of installation that is cost effective and operationally efficient.

It is a further object to provide a picket railing anchor system and method of installation of enhanced strength and durability allowing for increased safety and longevity.

Finally, it is a further object to provide a picket railing anchor system and method of installation that provides all of the above mentioned features and objectives.

These objects and advantages along with others will become evident in the following description and claims as set forth hereinafter.

DETAILED DESCRIPTION OF THE INVENTION

With reference to the drawings, FIGS. 1-18D depict the preferred and alternative embodiments of the instant invention which is generally referenced as a picket railing anchor system 10. The instant invention comprises a picket railing anchor system 10 that is designed to enhance the structural components, improve the efficiency and process of installation and maintenance, and withstand the forces realized in high velocity hurricane zones ("HVHZ") and comparable high wind zones.

Figure 1:
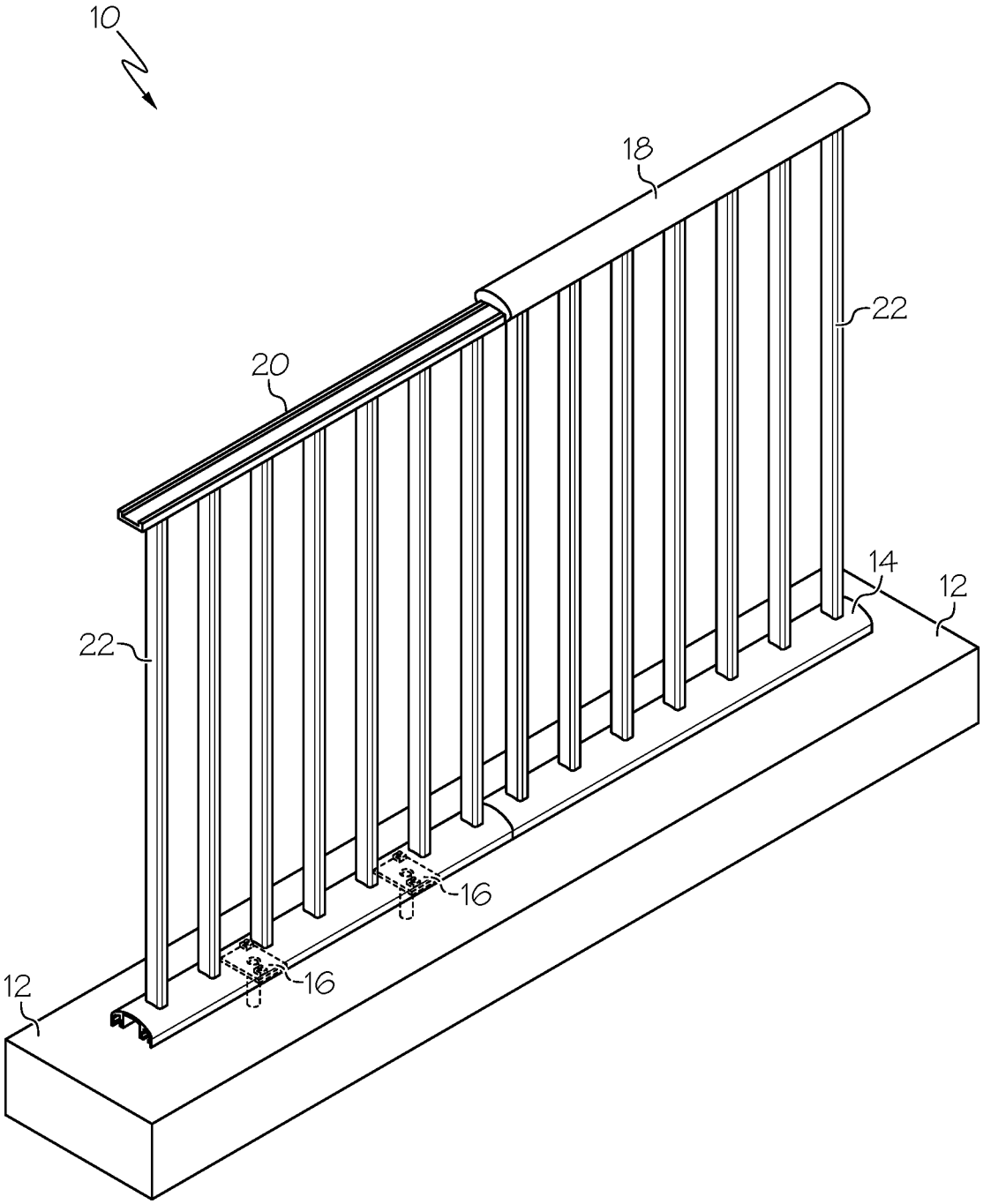
FIG. 1 is a perspective view of the picket railing system installed on a balcony section with partial internal components shown in accordance with the preferred embodiment of the instant invention.

With reference to FIG. 1, the picket railing anchor system 10 is adapted for installation on a section 12 of balconies on high rise buildings. The instant invention may also be installed on balconies of buildings in high wind zones, such as those on the beach or on building decks. The picket railing anchor system 10 generally comprises an aluminum bottom rail, base member 14, which is formed with an internal channel and integral track system, and a plurality of vertical picket rails 22 supported by the base member 14. Base member 14 receives anchor assemblies 16 described in detail below.

The system may also include a variety of top rails 18 acting as caps. The top rails 18 and bottom rails or base members 14 can be either welded at weld joints, attached by hardware, or otherwise secured to picket rails 22, or top rails 18 may be attached to an internal upper member 20 that is welded or otherwise secured to picket rails 22.

The instant invention 10 is described in more detail hereinafter.

Figure 2:
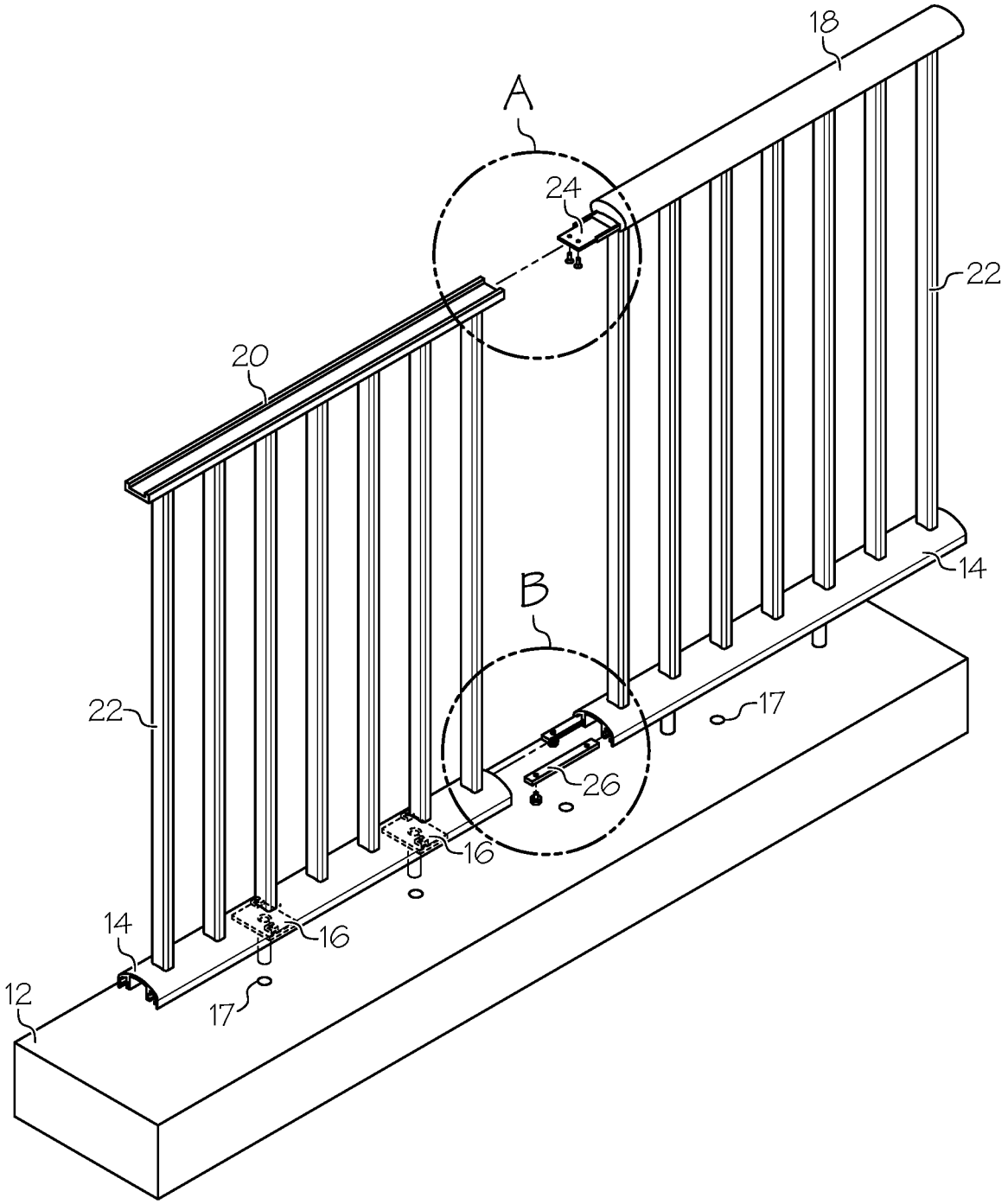
FIG. 2 is an exploded assembly perspective view of the apparatus shown in FIG. 1.
Figure 3:
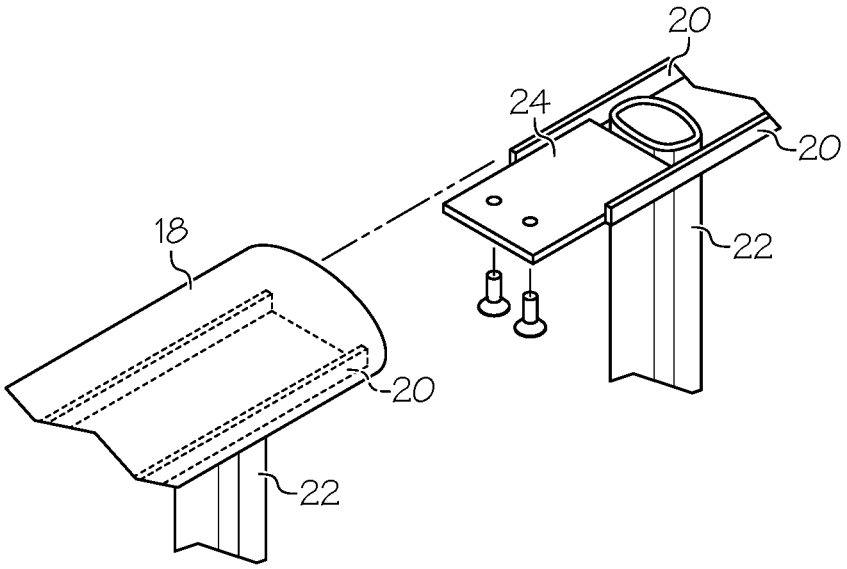
FIG. 3 is a partial exploded assembly perspective view of the apparatus shown in section A of FIG. 2.

With reference to FIG. 2, the picket railing anchor system is shown prior to assembly and installation on balcony section 12 or building deck. The picket rail sections can be attached to one another as shown in Section A utilizing top rail insert 24 which is inserted internally into adjoining top rails 18 as shown and attached with hardware. Section A components are detailed in enlarged exploded view of FIG. 3.

Similarly, adjoining base rail members 14 can be attached utilizing inserts 26 as shown in Section B. Section B components are detailed and enlarged in FIG. 4.

Figure 4:
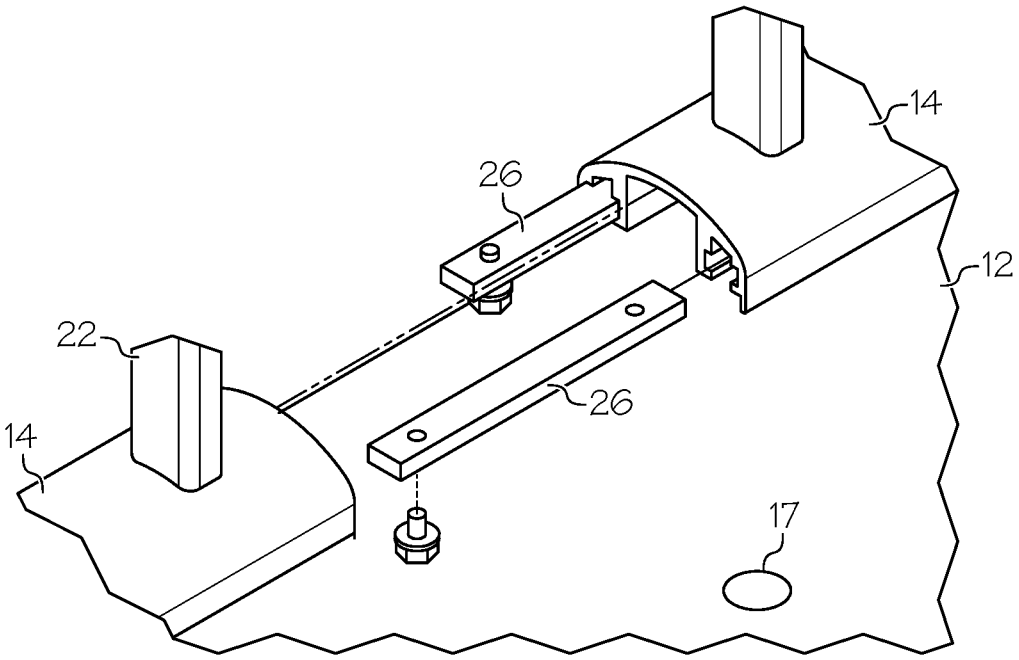
FIG. 4 is a partial exploded assembly perspective view of the apparatus shown in section B of FIG. 2.

Anchor assemblies 16 are inserted into receiving voids or pre-drilled holes 17 in balcony section 12 illustrated in FIGS. 2 and 4, or a building deck, as detailed hereinafter.

Figure 5:
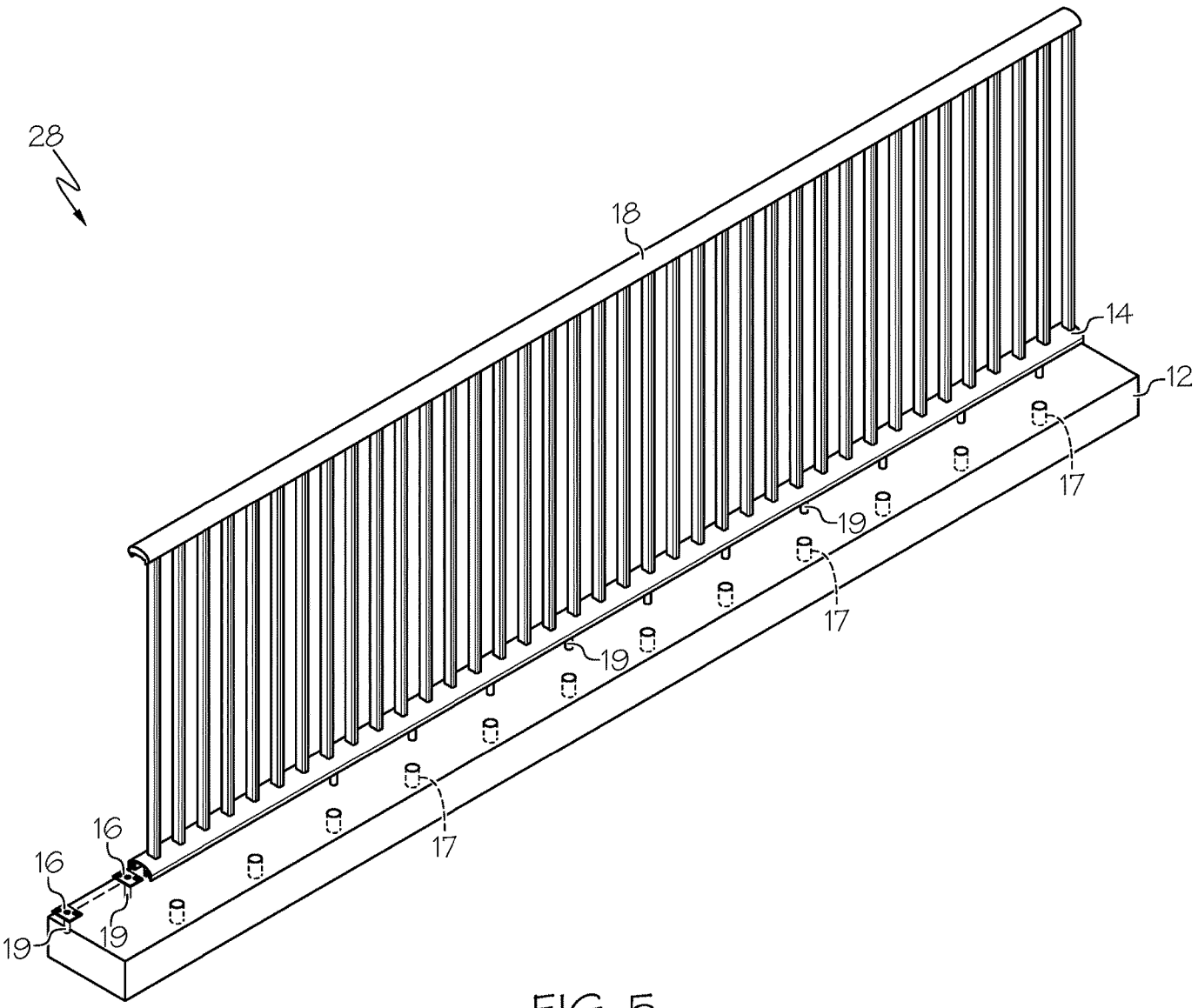
FIG. 5 is a perspective view of the picket railing system prior to installation on a balcony section in accordance with the preferred embodiment of the instant invention.

FIG. 5 depicts a picket railing section 28 prior to installation, and anchor assemblies 16 in sliding engagement with internal keyways of base member 14. Multiply anchor assemblies 16 are selectively positioned within the base member 14, and in alignment with pre-drilled holes 17 in the balcony 12. Each anchor assembly includes a central post member 19 that is secured within an aligned hole 17.

Figure 6:
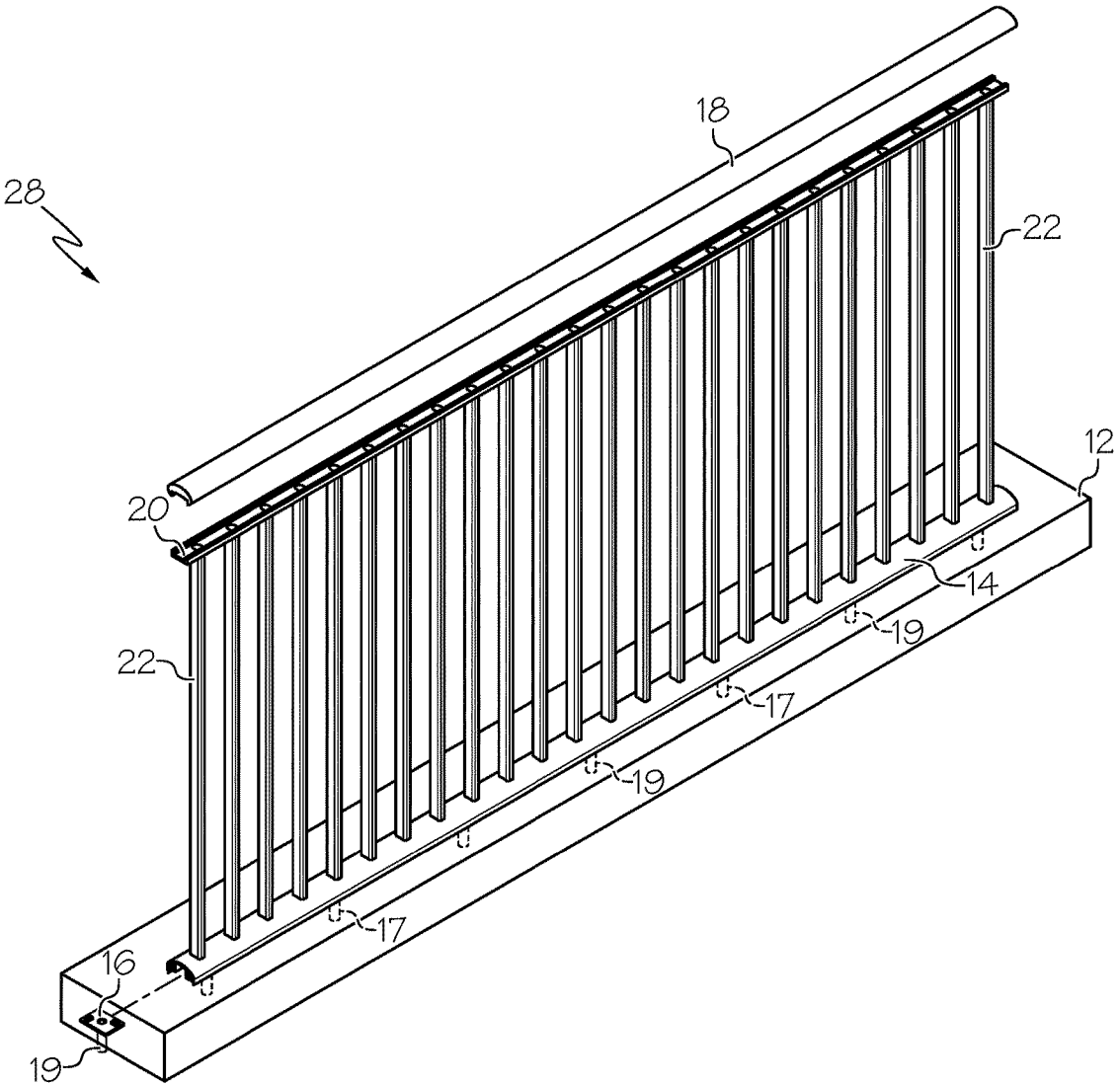
FIG. 6 is an exploded assembly perspective view of the apparatus shown in FIG. 5.

With reference to FIG. 6, rail section 28 is shown as being installed on the balcony 12, with anchor assembly posts 19 entered within holes 17.

Figure 7:
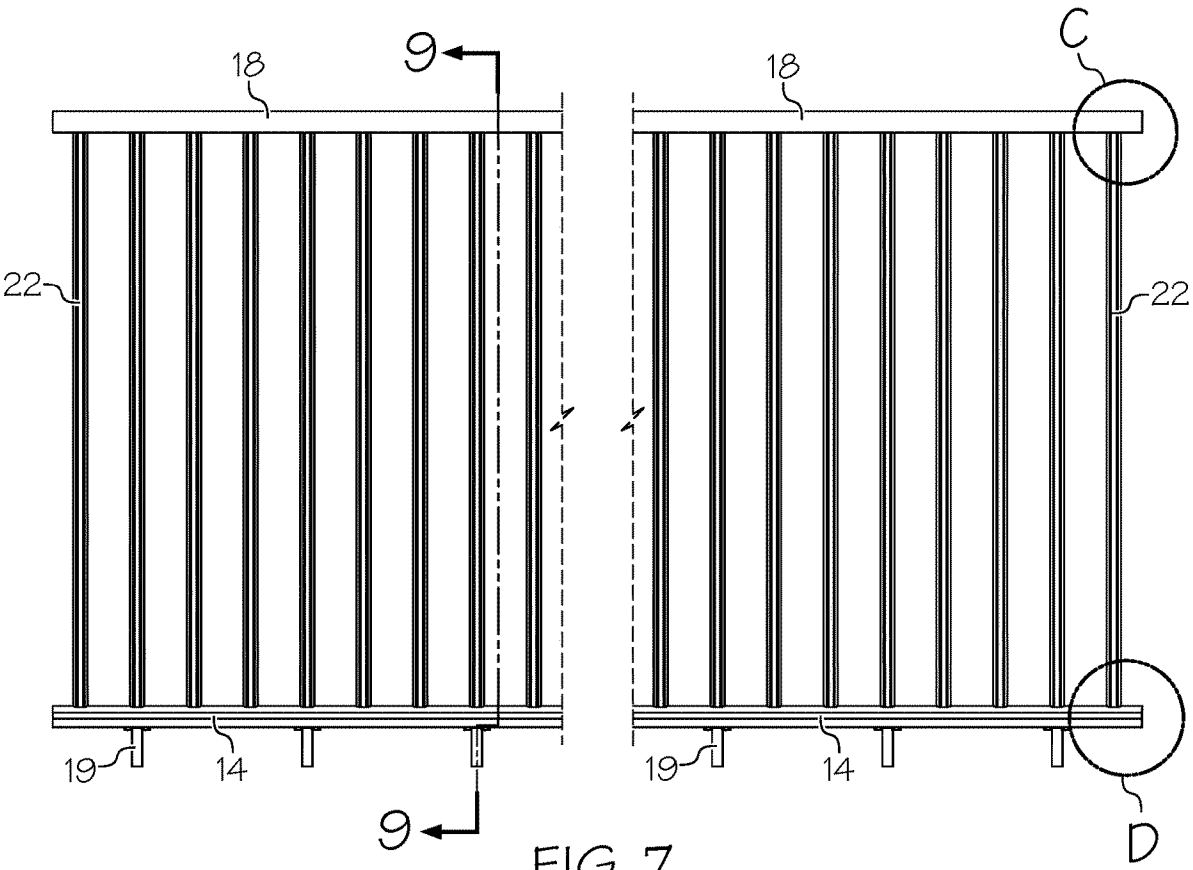
FIG. 7 is a side plan view of sections of the picket railing system of the instant invention.

FIG. 7 is a side plan view of sections of the picket railing system of the instant invention illustrating the anchor assemblies 16 inserted within base member rail 14 and anchor posts 19 extending downwardly therefrom. Top rail Section C and bottom rail Section D are shown in FIG. 9 as well.

Figure 8:
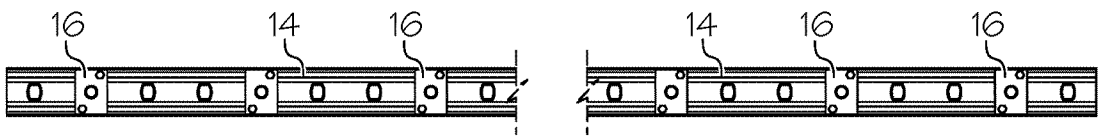
FIG. 8 is a bottom plan view of the apparatus shown in FIG. 7.

FIG. 8 is a bottom plan view of the apparatus shown in FIG. 7, and depicts anchor assemblies 16 in spaced apart relations within base member 14.

Figure 9:
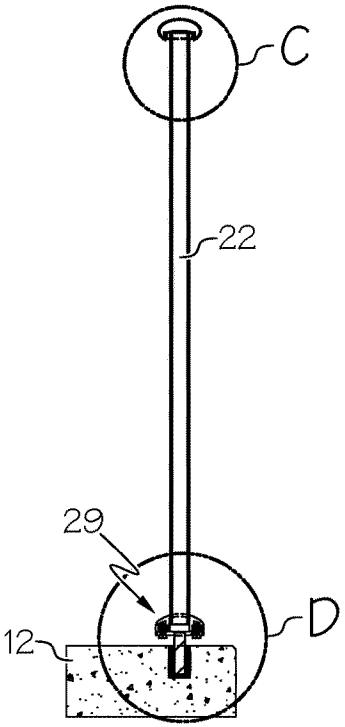
FIG. 9 is cross sectional side view along line 9-9 of the apparatus shown in FIG. 7.

FIG. 9 is cross sectional side view taken along line 9-9 of the apparatus shown in FIG. 7, depicting Top rail Section C and bottom rail Section D. Section D illustrates and anchor assembly inserted within the base member, and also secured within a balcony section 12. Section D is enlarged and detailed in FIG. 10.

Figure 10:
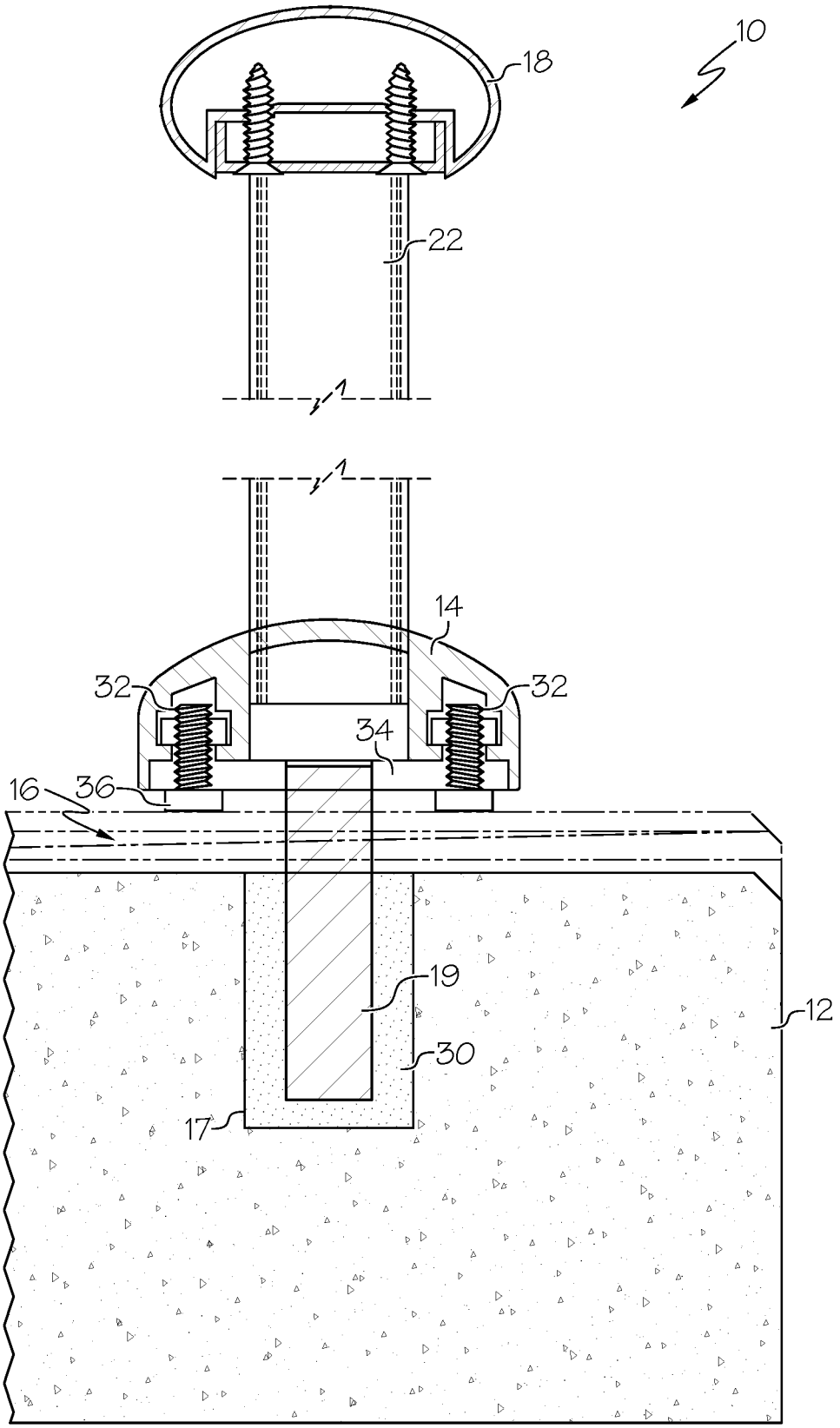
FIG. 10 is a cross sectional side view of the picket railing system as installed on a balcony in accordance with the preferred embodiment of the instant invention.

With reference to FIG. 10, a cross sectional side view of the picket railing system 10 is shown installed on a balcony in accordance with the preferred embodiment of the instant invention. Picket rail 22 is attached to top rail 18 and bottom rail 14. Anchor assembly 16 is shown when inserted into base rail member 14 through base member slidable keyways 32 that receive a pair of upper elevated rails 38 shown hereinafter of sliding anchor post assembly 16. Anchor post 19 is secured within hole 17 of balcony 12 by utilizing the appropriate epoxy anchoring and bonding adhesives 30 for concrete as described above.

As illustrated in FIGS. 11 through 16, anchor assembly 16 includes mounting plate 34, upper elevated rails 38, rods 40, central post 19, and optionally hardware bolt or nut 36 when desired.

Figure 11:
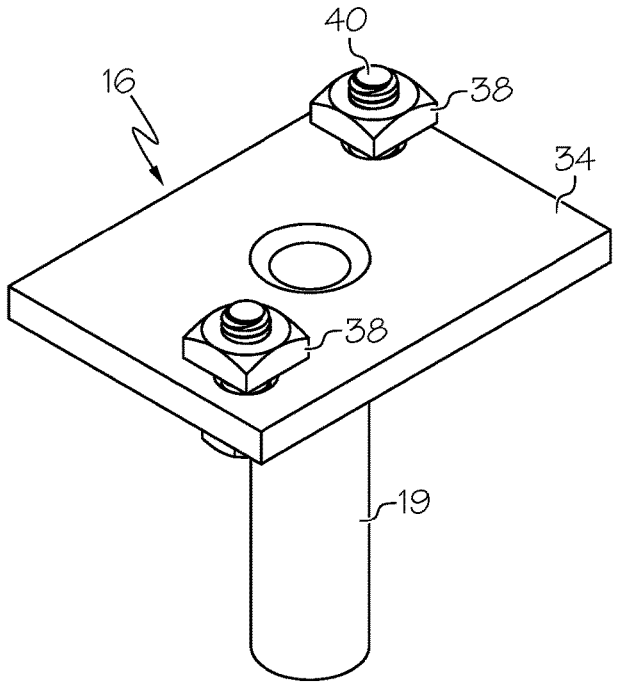
FIG. 11 is a perspective view of the anchor rod assembly of the instant invention.

FIG. 11 is a perspective view of anchor assembly 16 and its components.

Figure 12:
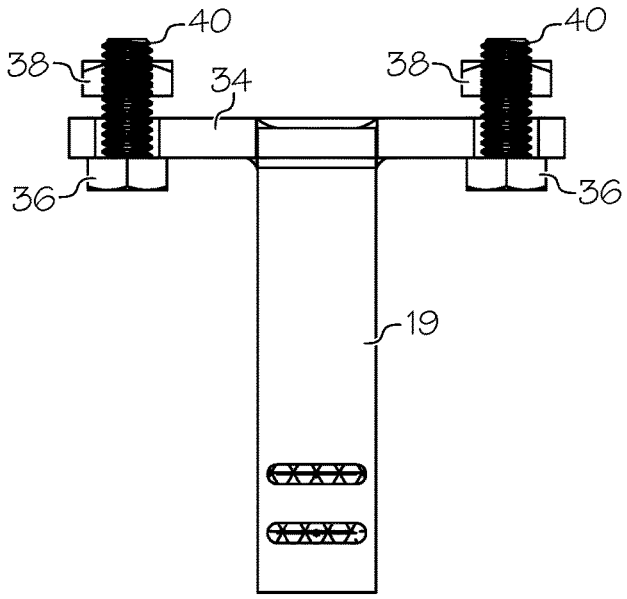
FIG. 12 is a cross sectional front plan view of the anchor rod assembly shown in FIG. 11.

FIG. 12 is a cross sectional front view of the anchor assembly 16 shown in FIG. 11.

Figure 13:
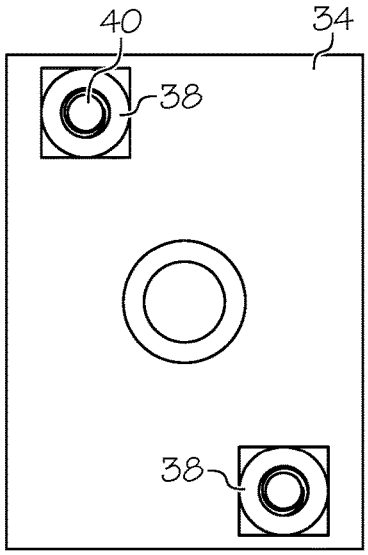
FIG. 13 is a top plan view of the anchor rod assembly shown in FIG. 11.

FIG. 13 is a top view of anchor assembly 16 shown in FIG. 11.

Figure 14:
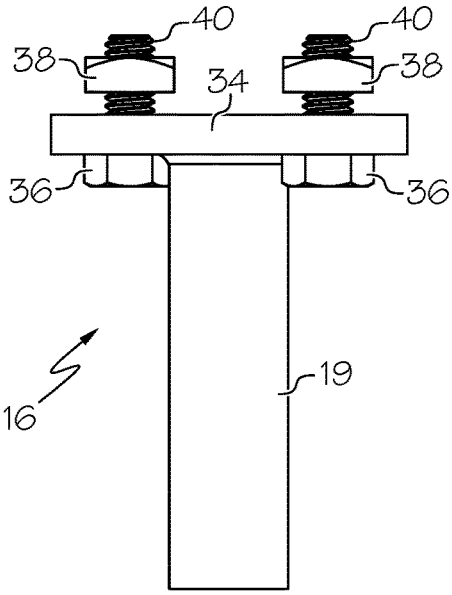
FIG. 14 is a side plan view of the anchor rod assembly shown in FIG. 13.

FIG. 14 is a side view of anchor assembly 16 shown in FIG. 13.

Figure 15:
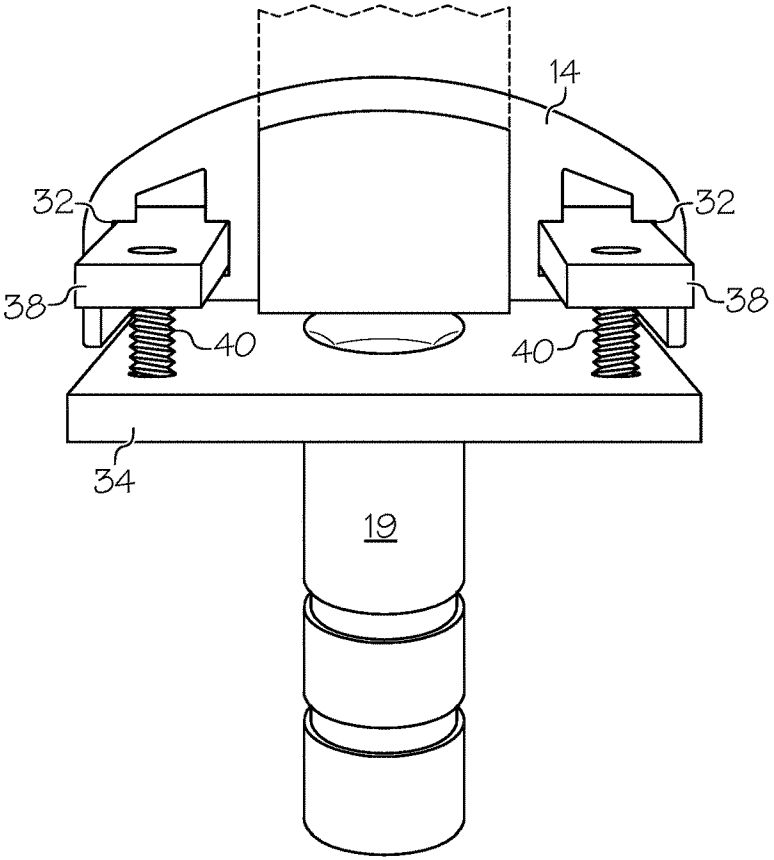
FIG. 15 is a perspective view of the of the picket railing system showing the insertion using the sliding anchor rod assembly in accordance with the preferred embodiment of the instant invention.

FIG. 15 is a perspective view of the of picket railing system 10 showing the insertion using sliding anchor assembly 16 in accordance with the preferred embodiment of the mechanical components.

Figure 16:
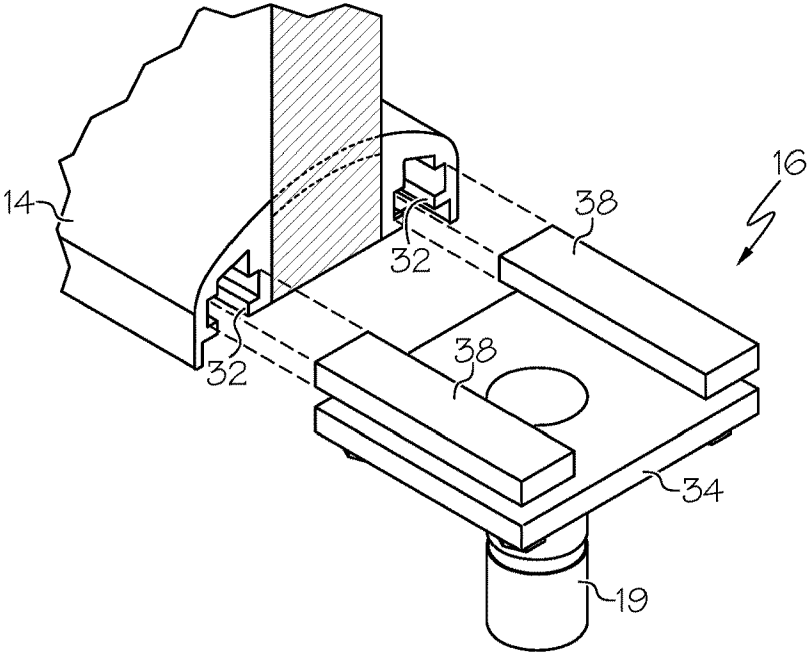
FIG. 16 is an exploded perspective view of the picket railing system showing the insertion using the sliding anchor rod assemblies in accordance with the preferred embodiment of the instant invention.

FIG. 16 is an exploded perspective view of the picket railing system 10 showing the insertion using the sliding anchor assemblies 16 in accordance with the preferred embodiment of the mechanical components.

Elevated rails 38 can be elongated if desired and are elevated above mounting plate 34 by rods 40, which can be hardware pins, bolts, adjustable screws or the like. Rails 38 are mounted on opposite sides of mounting plate 34, and each rail is supported, and elevated, by on or more rod members 40. Rails 38 are dimensioned as appropriate for positioning on mounting plate 34.

The improved sliding anchor assembly 16 provides substantially enhanced structural support for the picket railing extruded base 14. Mounting plate 34 and rails 38 combine to support the entire base 14 along with post 19.

The central anchor post 19 also provides substantially improved structural support, as it is relatively large in diameter and centered within mounting plate 34 for a single post embedded within a concrete slab. The entire sliding anchor post assembly 16 is designed as a single integrated unit, which slidingly engages the picket railing extruded base 14 for selective placement in the installation process. Keyways 32 receive elevated rails 38 in sliding engagement as shown, and multiple anchor assemblies 16 can be selectively position anywhere along base member 14 for appropriate strength of the picket railing, or to avoid damaging the concrete, internal rebar or other structure or compositions.

Referring now to FIGS. 17A through 17E, illustrated are cross sectional side plan views of alternative designs for caps or top rails 42, 44, 46, 48 and 50 for the picket railing system of the instant invention. Rail designs, geometric designs, shapes, dimensions, thicknesses, openings and profiles are matters of choice and aesthetics.

Figure 17D:
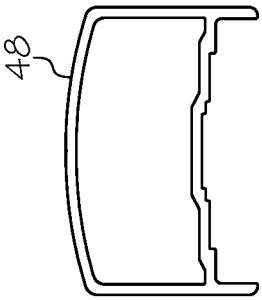
FIG. 17D is a cross sectional side plan view of an alternative embodiment of the top rail of the picket railing system of the instant invention.
Figure 17C:
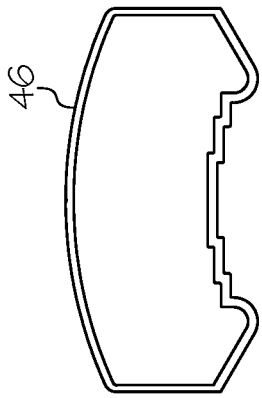
FIG. 17C is a cross sectional side plan view of an alternative embodiment of the top rail of the picket railing system of the instant invention.
Figure 17B:
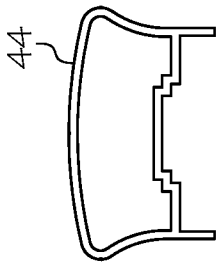
FIG. 17B is a cross sectional side plan view of an alternative embodiment of the top rail of the picket railing system of the instant invention.
Figure 17A:
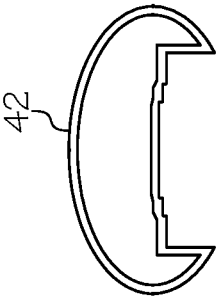
FIG. 17A is a cross sectional side plan view of top rail of the picket railing system of the instant invention.
Figure 17G:
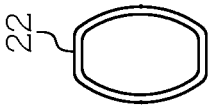
FIG. 17G is a cross sectional top plan view of a vertical picket rail of the picket railing system of the instant invention.
Figure 17F:
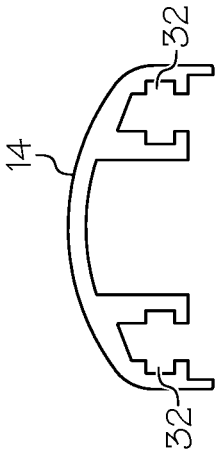
FIG. 17F is a cross sectional side plan view of the bottom rail of the picket railing system of the instant invention.
Figure 17E:
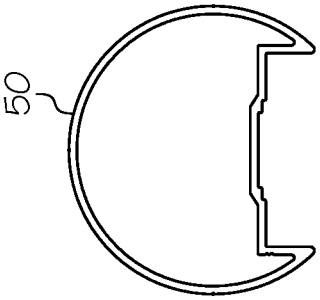
FIG. 17E is a cross sectional side plan view of an alternative embodiment of the top rail of the picket railing system of the instant invention.

FIG. 17F is a cross sectional side plan view of the bottom rail 14 and illustrating the keyways 32 about each side of the rail 14. It is appreciated that the bottom rail, base member 14, can be of any shape, and can also include means for receiving an aesthetic skirt.

FIG. 17G is a cross sectional top plan view of a vertical picket rail 22 as utilized in the picket railing system of the instant invention.

Figure 18A:
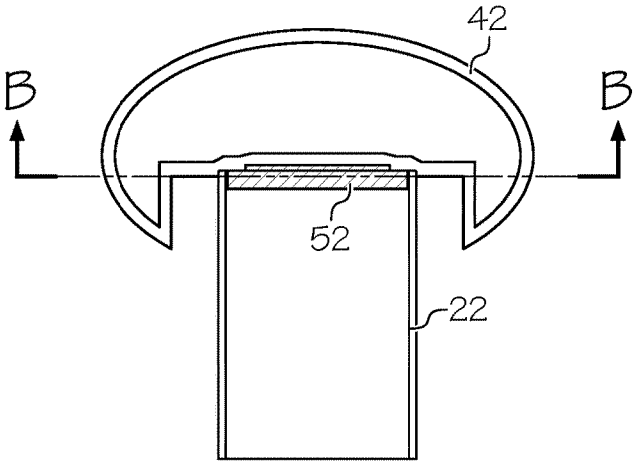
FIG. 18A is a side cross sectional side plan view of a top rail of the picket railing system welded to a vertical picket rail.

FIG. 18A is a side cross sectional side plan view of top rail 42 depicting weld detail 52 for securing top rail 42 to vertical picket rail 22.

Figure 18B:
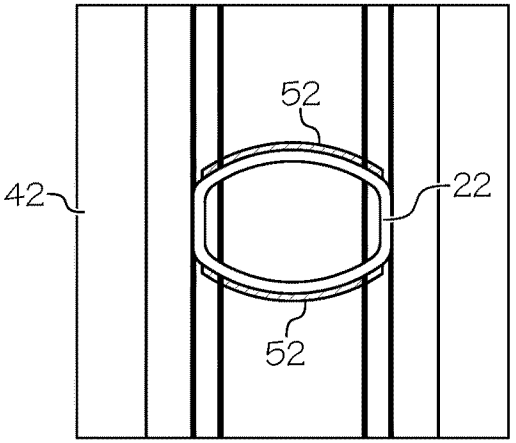
FIG. 18B is a cross sectional top plan view of the apparatus shown in FIG. 18A along line B-B.

FIG. 18B is a cross sectional top plan view of the apparatus shown in FIG. 18A taken along line B-B.

Figure 18C:
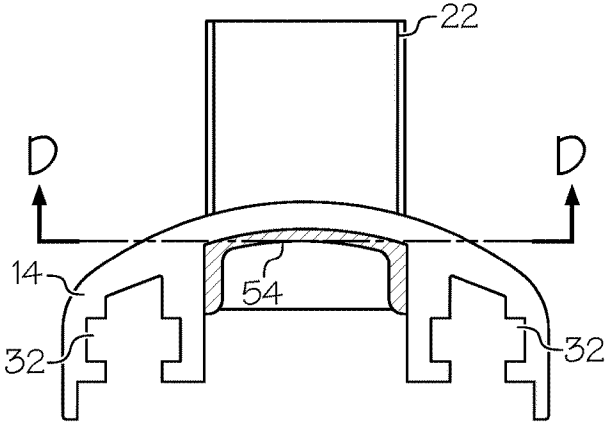
FIG. 18C is a cross sectional side plan view of a bottom rail of the picket railing system welded to a vertical picket rail.

FIG. 18C is a cross sectional side plan view of bottom rail 14 of the picket railing system and weld detail 54 securing bottom rail 14 to vertical picket rail 22. Also shown are keyways 32 of bottom rail 14.

Figure 18D:
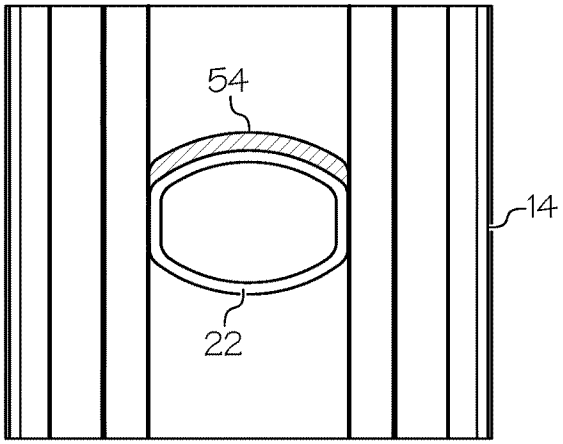
FIG. 18D is a cross sectional top plan view of the apparatus shown in FIG. 18C along line D-D.

FIG. 18D is a cross sectional top plan view of the apparatus shown in FIG. 18C taken along line D-D.

The keyways 32 comprise generally continuous slots that extend along the length of the base 14. The instant sliding anchor post assembly improves the uniform distribution of structural support, as well as the tension, compressive loads and rotational forces to meet specific wind loads realized along the base, picket rails and anchors. The picket railing anchor system 10 takes advantage of the tensile strength of the anchor assemblies 16 by staggering and spacing them to provide multiple lines of resistance. If one area of a building has higher wind loads, the spacing between the anchors 16 can be easily and quickly be reduced in order to resist the higher wind loads. The anchor spacing is also adjusted to prevent contact with reinforcing bars in the concrete substrate, which avoids damage to the bars. The anchor posts 19 are set in high strength epoxy 90, as shown in FIG. 10 which provides for a water proof anchor point and eliminates the stresses that traditionally used expansion anchors create. The anchors are also strategically placed so they are not visible from normal view.

Base 14 is secured to a concrete substrate with the height adjustable anchor assemblies 16 that slide into the keyways, secure the base and allow for adjustment of railing height, positioning of the anchors 16 and leveling which obviates the need to use unsightly leveling shims.

The anchor assembly 16 components, plate, rails, post and hardware are preferably comprised of stainless steel (SS). The central posts 19 are secured and set in a high strength epoxy, such as two part high strength epoxy, cementitious grout, or other alternative anchoring material, and mixed with sand filler in holes drilled in the concrete substrate. These dimensions may vary without departing from the scope and spirit of the instant invention 10.

The instant invention 10 provides a wide base 124 with the opposing elongated keyways 32 that accommodate two rails 38 of each anchor assembly 16, which increase the resistance to force applied by people or objects, or shearing wind forces such as those in HVHZ's and the structural integrity of the base anchor 16. The slots 32 also allow the anchors 16 to be moved which facilitates pre-coating and staggering, relocating and adjusting the anchor assemblies 16 without requiring drilling in the field when an anchor must be relocated to avoid contact with rebar in the concrete and allow closer placement to the concrete substrate's edges. The extruded designs also reduces weight and offers flexibility in designing the base in various shapes and reduces costs in manufacturing.

In regard to the instant improved anchor assembly 16 several substantial enhancements and significant structural support factors are achieved. This new anchor system offers additional benefits in construction by allowing anchor holes to be pre-sleeved with removable styrofoam blocks as opposed to being drilled in place after casting of reinforced concrete structure resulting in efficiencies in the speed of installation, improve safety for the installation crew, and most importantly, eliminating damages to integral reinforcing steel within the reinforced concrete structure. This new system and anchor assemblies ensures the preservation of the foundation of newly constructed projects providing for a longer service life of the related materials. Additionally, in the event that field installed pre-sleeved Styrofoam inserts are misplaced, the new sliding anchor assembly is capable of being adjusted laterally to coincide with the actual field location of the pre-sleeved Styrofoam insert which may have shifted from the original planned location during the forming and pouring operations of the reinforced concrete structure. This improved system also eliminates the need for the drilling of numerous anchor holes, which leads to significant damage to the reinforcing steel within the concrete structures, which thereafter allows for the onset of damages due to premature deterioration.

The new anchor system also provides for much larger spans between the placement of anchor assemblies and posts, reducing the frequency of anchor holes and drilling. Reduced frequency also allows for avoiding damage or conflict with the reinforcing steel elements, and much more efficient installation by reducing the labor required due to less processes required for installation of, and requirement for, materials.

As referenced above, the anchor mounting plate reinforces the aluminum shoe base by providing a wider surface area of contact and acting as a bridge by way of clamping and preventing the lower surface of the aluminum shoe base from deforming or bending, resulting in increased bending resistance and the ability to remain rigid and structurally sound at higher forces and pressures. The new, significantly larger, central anchor post provides an improved structural support for the railings and base, and efficient use of materials in the manufacturing and installation process. The central anchor post configuration also provides for additional edge distance between the anchor assembly and the edge of the slab where edge reinforcement bars are typically located. This design also significantly increases section modulus and greater availability of higher yield materials offers greater resistance to deleterious bending resulting in much greater resistance to higher wind loads.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A picket railing anchor system for securing a picket railing to a concrete substrate, comprising:

at least one picket railing section;

an elongated base member, said base member having means for receiving said picket railing section;

said base member further including at least one keyway for receiving means for anchoring said base member;

means for anchoring said base member, said means for anchoring said base member including an anchor assembly, said anchor assembly slidably engaging said keyway for selectively positioning and securing said base member;

said anchor assembly including a mounting plate, and at least one elevated rail member;

said anchor assembly further including a post member;

said elevated rail member secured to said mounting plate;

said post member centrally positioned and secured to said mounting plate; and said post member for being secured to said concrete substrate.

2. The apparatus of claim 1, wherein said mounting plate elevates said base member.

3. The apparatus of claim 1, wherein said keyway further includes means for drainage within said keyway.

4. The apparatus of claim 1, wherein said base member further includes means for receiving an aesthetic skirt about said base.

5. The apparatus of claim 1, wherein said base member includes two keyways, one said keyway formed about opposite sides of said base member;

said anchor assembly including two elevated rail members secured to said mounting plate; and said elevated rail members slidably engaging said keyways for selectively positioning and securing said base member.

6. A picket railing anchor system for securing a picket railing to a concrete substrate, comprising:

at least one picket railing section;

an elongated base member, said base member having means for receiving said picket railing section;

said base member further including a plurality of keyways for receiving an anchor assembly;

at least one said anchor assembly for securing said base member;

said anchor assembly including a plurality of elevated rail members;

said plurality of elevated rail members slidably engaging said plurality of keyways for selectively positioning and securing said base member;

said anchor assembly including means for elevating said base member above said concrete substrate; and said anchor assembly including a lower post member centrally positioned with respect to said base member for being secured to said concrete substrate.

7. The apparatus of claim 6, wherein said means for receiving said picket rail section includes weld joints.

8. The apparatus of claim 7 wherein said base member includes two keyways, said two keyways on opposite sides of said base member;

said anchor assembly including two elevated rail members secured to a mounting plate; and said elevated rail members slidably engaging said keyways for selectively positioning and securing said base member.

9. The apparatus of claim 8, wherein at least one said elevated rail member is elongated.

10. A picket railing anchor system for securing a picket railing to a concrete substrate, comprising:

a plurality of picket railing sections;

an elongated base member, said base member having means for receiving said plurality of picket railing sections;

said base member further including a plurality of keyways;

a plurality of anchor assemblies for securing said base member;

each said anchor assembly including a plurality of elevated rail members;

each said elevated rail member slidably engaging one of said plurality of keyways for selectively positioning and securing said base member;

at least one said anchor assembly including means for elevating said base member above said concrete substrate; and each said anchor assembly including a lower centrally positioned post member for being secured to said concrete substrate.

11. The apparatus of claim 10, wherein at least one said elevated rail member is elongated.

12. The apparatus of claim 11, wherein said means for receiving said plurality of picket rail sections constitutes said plurality of keyways being continuous within said base member.

* * * * *